US005621961A

United States Patent [19]

Schleicher

[11] Patent Number: 5,621,961

[45] Date of Patent: Apr. 22, 1997

[54] METHOD FOR FORMING A CLINCH JOINT TECHNICAL FIELD

[75] Inventor: Louis C. Schleicher, Warren, Mich.

[73] Assignee: Techline Engineering Co., Warren, Mich.

[21] Appl. No.: 467,763

[22] Filed: Jun. 6, 1995

Related U.S. Application Data

[62] Division of Ser. No. 188,391, Jan. 27, 1994, Pat. No. 5,490,310, which is a continuation of Ser. No. 526,066, May 18, 1990, abandoned.

[51] Int. Cl.[6] ..... B23D 11/00

[52] U.S. Cl. ..... 29/509; 29/243.5

[58] Field of Search ..... 29/243.5, 243.52, 29/243.53, 283.5, 21.1, 509, 522.1, 798, 524.1, 505

[56] References Cited

U.S. PATENT DOCUMENTS

| | | |
|---|---|---|
| 3,359,935 | 12/1967 | Rosbottom . |
| 3,579,809 | 5/1971 | Wolf . |
| 4,208,776 | 6/1980 | Schleicher . |
| 4,394,794 | 7/1983 | Shirey . |
| 4,459,735 | 7/1984 | Sawdon . |
| 4,569,111 | 2/1986 | Mutou . |
| 4,584,753 | 4/1986 | Eckold et al. . |
| 4,614,017 | 9/1986 | Eckold et al. . |
| 4,632,592 | 12/1986 | Gunter . |
| 4,658,502 | 4/1987 | Eckold et al. . |
| 4,752,992 | 6/1988 | Oaks . |
| 4,760,632 | 8/1988 | Rapp . |
| 4,831,704 | 5/1989 | Rapp . |
| 4,856,316 | 8/1989 | Slasinski . |
| 4,896,414 | 1/1990 | Hafner . |
| 4,905,362 | 3/1990 | Obrecht et al. . |
| 4,930,203 | 6/1990 | Obrecht et al. . |
| 5,046,228 | 9/1991 | Eckhold et al. . |
| 5,051,020 | 9/1991 | Schleicher . |
| 5,208,974 | 5/1993 | Sawdon et al. . |
| 5,305,517 | 4/1994 | Schleicher . |
| 5,315,743 | 5/1994 | Schleicher . |

FOREIGN PATENT DOCUMENTS

| | | |
|---|---|---|
| 526042 | 3/1955 | Italy . |

OTHER PUBLICATIONS

SAE Technical Paper Series, "A New Mechanical Joining Technique for Steel Compared With Spot Welding", by J.M. Sawhill, Jr. and S.E. Sawdon, 1983.

*Primary Examiner*—Robert C. Watson
*Attorney, Agent, or Firm*—Brooks & Kushman P.C.

[57] ABSTRACT

An apparatus for forming a clinch joint in overlapping sheets of deformable material and the related method is disclosed. The apparatus includes a die assembly which cooperates with a punch. The die assembly includes an elongated mandrel having an anvil projecting axially from one end for deforming the sheets of material squeezed between the anvil and the punch. The mandrel is larger than the anvil to define a shoulder thereabout generally perpendicular to the die axis. An expandable die button is coaxially aligned upon the mandrel and is provided with a base ring encircling the mandrel and a plurality of die segments. The die segments each have a head portion and a leaf portion extending between the head and the base ring. The head portions collectively provide a die face surrounding the anvil to support the sheet of material and to define a central recess into which the punch can draw the material forming the joint, each head portion having a land parallel to and cooperating with the mandrel shoulder to transmit the axial load exerted thereon into the mandrel without transmitting axial load through the leaf portions. Alternative embodiments of the apparatus are disclosed for forming leak proof and lance type clinch joints.

3 Claims, 4 Drawing Sheets

METHOD FOR FORMING A CLINCH JOINT

TECHNICAL FIELD

This is a division of application Ser. No. 08/188,391 filed on Jan. 27, 1994, now U.S. Pat. No. 5,490,310, which is continuation of U.S. Ser. No. 07/526,066 filed May 18, 1990 now abandoned.

TECHNICAL FIELD

This invention relates to fastening sheets of deformable material and more particularly to methods and apparatus performing clinch joints of both the leak proof and lanced type.

BACKGROUND ART

Clinch joints for fastening sheets of deformable material such as sheet metal or the like have been used for over one hundred years. Lanced clinch sheet metal joints are used today which are very similar in design as shown in U.S. Pat. No. 56,494—Gordon, issued in 1866. Over the years, clinching has experienced limited commercial utilization and currently the most popular method of fastening overlapping segments of sheet metal together is spot welding. Spot welding poses problems, particularly in certain applications such as when using dissimilar metals, metals having protective coatings, metals with different thicknesses or hard to weld materials. Clinch joints are not problem free either and whether to use a spot welder or a clinch joint must be determined on an application by application basis. Clinch joints of the lanced variety shear the metal exposing the central portion of the sheet to the atmosphere. A lanced joint is not suitable when a leak proof joint is necessary, or where the metal sheets have corrosion resistant coatings or the joint must be pressure-tight, such as a beverage can tab top attachment.

Leak proof clinch joints are well known, but have yet to experience wide spread commercial uses. Leak proof clinch joints of a conventional design are shown in U.S. Pat. No. 3,359,935—Rosbottom, U.S. Pat. No. 3,579,809—Wolf, U.S. Pat. No. 4,459,735—Sawdon, and described in detail in SAE Technical Paper, A New Mechanical Joining Technique for Steel Compared to Spot Welding, J. M. Sawhill and S. E. Sawdon, No. 830128. Conventional leak proof clinch joints are formed by simultaneously drawing a pair of cup-shaped cavities nested one within the other between a punch and die. Once the cavities are drawn, the spot forming the central region of the cavity is squeezed axially to radially deform and interlock the nested cavities.

When forming clinch joints of either the lanced or leak proof type, it is important to accurately control the manufacturing and tolerances of the punch and die assembly used and to carefully maintain alignment. Many die assemblies are formed of a series of die segments which are outwardly radially biasable as the central spot of the clinch joint is axially compressed between a punch and an anvil. During the drawing and squeezing of the spot operation, very significant axial load is exerted on the die segments. When the die segments are massive, such as the hinge die segments utilized in Sawdon, axial load is not a problem, however, when a flexible die assembly is used, such as the one piece die button, as shown in U.S. Pat. No. 4,208,776, Schleicher or U.S. Pat. No. 4,569,111, Mutou when fabricated by assembly of the type illustrated in U.S. Pat. No. 4,614,017, Eckold, die segments break periodically if the segments are made very flexible and tend to hinder spot expansion if the die segments are stiff.

DISCLOSURE OF INVENTION

An object of the present invention is to provide apparatus for forming a clinch joint having a one piece die button with very flexible die segments without unduly stressing the die segments during the clinching operation.

Another object of the present invention is to provide an apparatus method performing a clinch joint which is easy to fabricate with high tolerances and simple to maintain in axial alignment when in use. These and other objects, advantages and features of the invention become more apparent upon review of the accompanying specification and drawings.

Accordingly, an apparatus for forming a clinch joint in a plurality of overlapping sheets of deformable material is provided along with a method for using same. The clinching apparatus includes a die assembly for use with a corresponding punch to form a clinch joint in overlapping sheets of material placed therebetween. The die assembly includes an elongated mandrel aligned along the die axis having an anvil projecting axially from one end to squeeze the sheets of formed material between the anvil and the punch. The mandrel is larger than the anvil so as to define a shoulder generally perpendicular to the die axis. An expandable die button is coaxially aligned and telescopically received upon the mandrel. The die button includes a base ring which encircles the mandrel in a plurality of die segments each having a radially outwardly biasable leaf portion cantileverly extending axially from the base ring toward the mandrel end. Attached to each leaf is an enlarged head portion extending radially inward toward the anvil each having a face surface which collectively provide a die face surrounding an anvil for supporting the sheet of material and defining a central recess therein into which the punch can draw the material to form the clinch. Each head portion has a land generally parallel to and cooperating with the mandrel shoulder to transmit axial load exerted thereon during joint formation into the mandrel without transmitting loads into the expandable die button leaf portions.

An embodiment is disclosed in which the die button central recess and corresponding punch are circular and are provided with sufficient radial clearance so that a leak proof joint may be formed. An alternative die assembly is provided in which the anvil and the die button central recess are generally rectangular in shape. Two die segments are provided each having a cutting edge at the corner of the die face adjacent the anvil for sharing a pair of parallel slits in the material forming the joint.

BEST MODES FOR CARRYING OUT THE INVENTION

First Apparatus Embodiment

Figure 5:
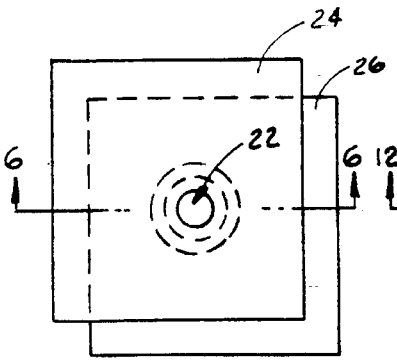
FIG. 5 is a plan view of two sheets of material having a leak proof joint formed therein.
Figure 6:
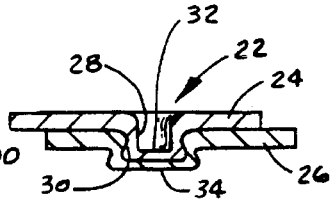
FIG. 6 is a cross-sectional view of the clinch joint taken along line 6—6 of FIG. 5.

The first embodiment of the clinch joint forming apparatus 20 is illustrated in FIGS. 1–4. Clinching apparatus 20 is used to form a leak proof joint 22 of the type illustrated in FIGS. 5 and 6. Joint is formed in a first and second overlapping sheet of material 24 and 26 which are locally placed adjacent to one another in the region of leak proof joint 22. A pair of nested first and second cup shaped cavities 28 and 30 are formed in the first and second sheets, respectively. Each of the cavities have a central spot 32 and 34 which are squeezed together sufficiently to cause the spots to permanently deform and radially expand interlocking the two cup shaped cavities securely together.

Figure 2:
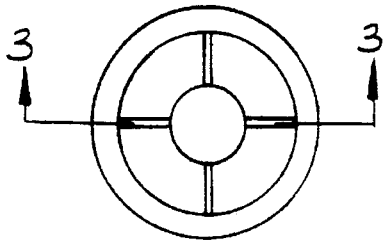
FIG. 2 is a plan view taken along line 2—2 of FIG. 1.
Figure 1:
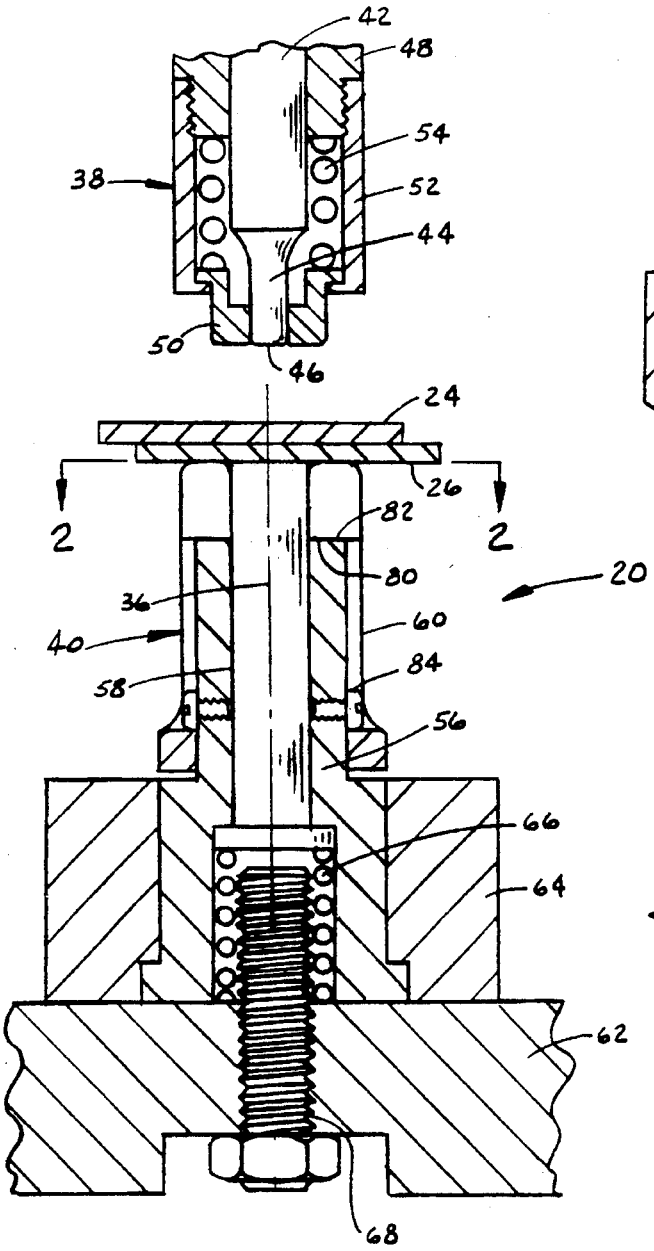
FIG. 1 is a side cross-sectional elevation of a first embodiment of the invention.

The apparatus 20 is shown in cross-sectional side elevational view in FIG. 1 in the opened position ready to begin the clinch joint forming operation. The two overlapped sheets of deformable material 24 and 26 are placed within the apparatus generally perpendicular to die axis 36. The apparatus is made up of a punch assembly 38 and a die assembly 40. Punch assembly 38 is made up of a circular punch 42 having a cylindrical punch projection 44 and a punch free end 46. The punch is retained in proper coaxial alignment with the die axis 36 by punch holder 48. Punch 42 is preferably removably affixed to punch holder 48 by a set screw or the like in conventional fashion. A stripper 50 surrounds the punch and is held in place by stripper ring 52 and stripper spring 54. Stripper spring 54 axially biases the stripper to the extended position illustrated in FIG. 1. During joint formation, the stripper shifts axially relative to the punch exposing the punch projection when the punch and die assemblies are shifted away from one another upon the completion of the joint formation, stripper 50 enables the punch to retract from the leak proof joint without pulling or lifting the sheets of material upwardly.

Figure 3:
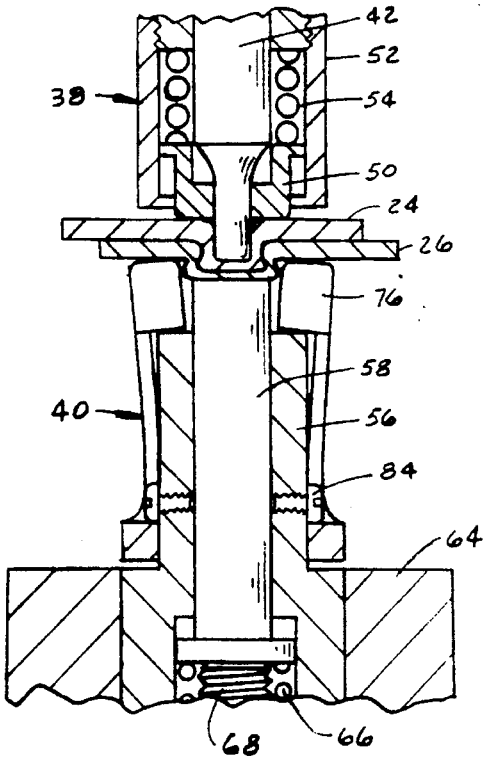
FIG. 3 is a cross-sectional side elevational view taken along line 3—3 in FIG. 2 showing the punch and die assembly axial compressed during joint formation.

Die assembly 40 is made up of three main components: A mandrel 56, an anvil 58 and a die button 60 which are coaxially aligned with one another and die axis 36. The die assembly 40 is affixed to a die base 62 by mandrel retainer 64. In the first embodiment of the invention, illustrated in FIG. 1, a spring loaded anvil is utilized, however, it should be noted that a fixed anvil could be used if so desired. Anvil 58 illustrated, is shiftable axially along the die axis, to define a central recess within the die during the forming operation. Anvil 58 is biased elastically to the raised position illustrated by anvil spring 66. Downward travel is limited by adjustable stop 68. As the punch and die are moved together axially to form the clinch joint as shown in FIG. 3, anvil 58 moves downwardly until it engages stop 68 as shown. Once anvil motion stops further downward movement of the punch causes the material therebetween to be plastically deformed radially. When the punch and die assembly are opened at the completion of the forming operation, anvil spring 68 causes the formed clinch joint to be expelled from within the central recess formed in the die assembly as shown in FIG. 4.

Figure 7:
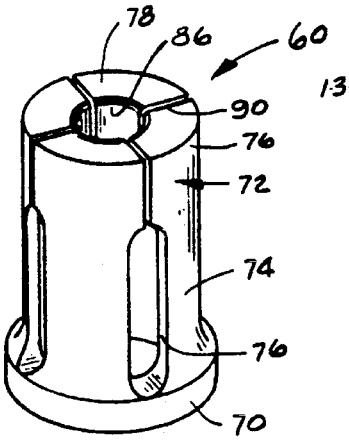
FIG. 7 is a perspective view of a die button utilizing the first embodiment of the invention.

The die button is best illustrated in FIG. 7 perspective view. Die button 60 is to be telescopically received and coaxially aligned upon the mandrel. Die button 60 has a base ring 70 which encircles the mandrel. Extending upwardly from the base ring in a cantilevered manner are a plurality of die segments 72. Each die segment is made up of a yieldable leaf portion 74 which extends axially upward from the base ring toward the free end of the mandrel. Affixed to the end of each leaf portion is enlarged head portion 76 which extends radially inwardly toward anvil 58. The head portions each have a base surface 78 which collectively provide a die face surrounding the anvil for supporting the sheet material and to define a central recess into which the punch can draw the material when forming the joint. Preferably, the die face is generally planar and perpendicular to the die axis 36. Each of the head portions is provided with a land surface 80 generally parallel to cooperating with a flat shoulder 82 formed on the mandrel first end.

When the joint is being formed, the axial loads exerted upon the die segments are transmitted from the die head portions to the mandrel by the cooperating land and shoulder surfaces, thereby minimizing the axial load exerted on the leaf portions. When the first and second central spots 32 and 34 in the leak proof joint are squeezed together between the punch free end 46 and the end of the anvil 58, die segment head portions 76 are outwardly radially biased. Leaf portions 74 are flexible enough to allow the head portions 76 to bias outwardly radially and are resilient enough to return the head portions to the normal inwardly biased position adjacent the anvil 58 once the leak proof joint is removed from the die central recess.

Figure 4:
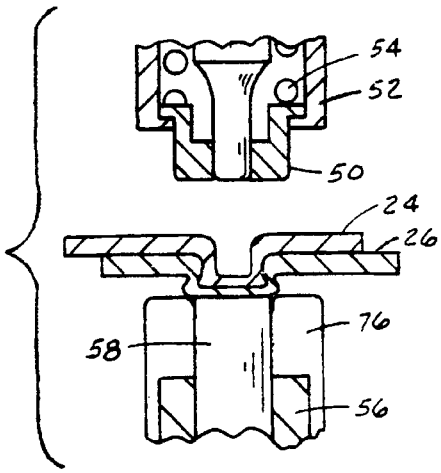
FIG. 4 is a side elevational view of the apparatus in the opened position.

The sequential operation of the first embodiment of the apparatus 20 is illustrated in FIGS. 1, 3 and 4. In FIG. 1, two sheets of overlapped deformable material are positioned between punch assembly 38 and die assembly 40. The punch and die are then moved together simultaneously drawing a pair of nested cup shaped cavities in the overlap sheets of material as shown in FIG. 3. It should be noted that cup shaped cavities and the amount of movement in the die segment head portion are exaggerated in order to more clearly illustrate the concept. After the joint is completely formed, the punch and die assembly opens as shown in FIG. 4 and the leak proof joint is expelled from within the die assembly central recess by the load exerted thereon by anvil spring 66. The sheets of material in which the joint is formed is then removed or advanced so that a new joint can be formed. The clinch joint forming apparatus 20 of the first embodiment specifically is designed to form circular leak proof joints. Punch 42 and anvil 58 are generally cylindrical elements with substantially flat ends. It should be noted, however, that slightly crowned or convex punch or anvil configurations can be utilized as is well known in the art not departing from the scope of the invention. In the first embodiment 20 illustrated in FIGS. 1–4, mandrel 56 is symmetrical about the die axis 36 and is provided with a first and a second end. The first end is provided with a substantially flat shoulder 82 which extends about the periphery of anvil 58. The second end of the mandrel is affixed to die base 62 by way of mandrel retainer 64. Die button 60 is telescopically inserted upon mandrel 56 so that land 80 which is on the underside of each of the head portions 76 which cooperate with shoulder 82. Preferably, land 80 and shoulder 82 are coplanar and perpendicular to the die axis 36. In order to prevent the die button from sliding off the mandrel retainer 84 such as a screw or the like is provided to cooperate with die button and the mandrel to prevent removal. Retainer 84 is not loaded when the joint is being drawn and will only be loaded slightly when the formed joint is being removed from the recessed cavity.

The mechanical configuration and tolerances of the die cavity and the punch vary as a function of the material thickness sought to be clinched and are calculated using conventional analytical or experimental techniques.

Die button 60 is formed of a single piece of tool steel bar stock. The die button is initially machined using a turning operation to cut all the surfaces which are symmetrical about the die axis. Depending upon the desired number of leaves, a plurality of slots 76 are then machined in the die button blank. Preferably the slots extend the entire length of leaf portion 74 in order to uniformly distribute stress. Slots 76 also serve to eliminate any stress concentration in the junction between the leaf portion 74 and the base ring 70. It is at this stage when any finish machining to establish the diameter of central region 86 may be done prior to heat treating. Once the die button is finish machined and hardened, it can then be split by cutting slits 90 utilizing an electrochemical machining or wire burning operation.

By making the die button out of a single piece of tool steel, the central recess can be carefully controlled and aligned with the inner diameter of the die button so that highly accurate alignment can be maintained. While the embodiment illustrated has four die segments, two or more die segments, preferably three or more die segments, can be utilized depending upon a particular application.

Second Apparatus Embodiment

Figure 11:
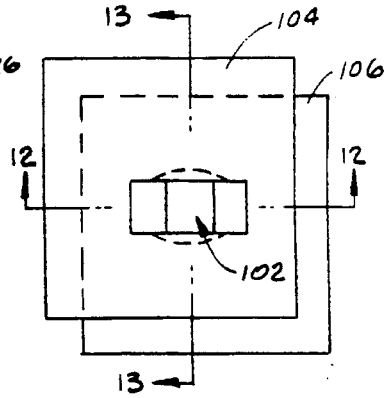
FIG. 11 is a plan view of two overlapping sheets of material having a lanced joint.
Figure 12:
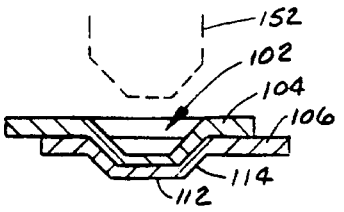
FIG. 12 is a cross-sectional side view of the joint of FIG. 11 taken along line 12—12.
Figure 13:
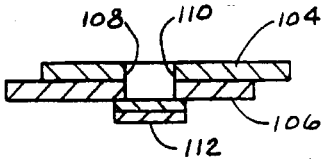
FIG. 13 is a cross-sectional end view of the joint of FIG. 11 taken along line 13—13.
Figure 9:
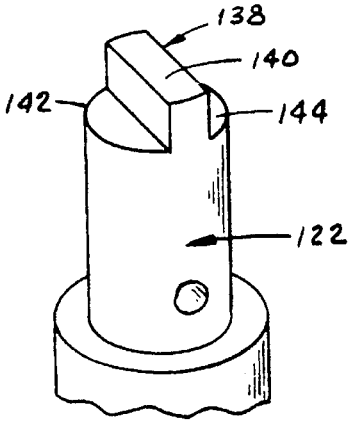
FIG. 9 is a perspective view of the mandrel utilized in FIG. 8.
Figure 10:
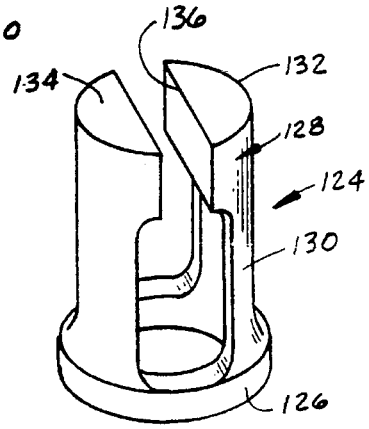
FIG. 10 is a perspective view of the die button utilized in FIG. 8.

A second clinch joint forming apparatus 100 is illustrated with reference to FIGS. 8–10. Apparatus 100 is used to form a lanced clinch joint 102 of the type shown in FIGS. 11–13. Lanced joint 102 is formed in first and second sheet of deformable material 104 and 106, respectively. Lanced joint 102 is formed by forming a pair of spaced apart parallel slits in the overlapping sheets of deformable material, deforming the material bounded therebetween out of the plane of the sheets. The material lying between the spaced apart slits 108 and 110 is provided with a central spot portion 112 and a web portion 114 which connects the central spot to the remainder of the sheet. The central spots in each of the first and second sheets are compressed together along the die axis in the same manner as the earlier described apparatus and embodiment causing the central spots to radially expand preventing the sheets from separating.

Second clinch forming apparatus 100 is provided with a die assembly 116 and a punch assembly 118 coaxially aligned with one another along the die axis 120. Die assembly 116 is made up of a mandrel 122 which is shown in perspective view in FIG. 9 and a coaxially aligned die button 124 which is shown in perspective view in FIG. 10. The die button includes a base ring 126 and a pair of die segments 128 which project axially upward therefrom. Each of the two die segments is provided with a thin leaf portion 130 and a relatively thick head portion 132. Each of the two head portions 132 are provided with a flat face 134 which is generally perpendicular to the die axis which defines a sharp cutting edge 136. Cutting edges 136 are spaced apart a distance corresponding to the size of the lance joint to be formed. In the embodiment illustrated, the cutting edges are parallel to one another, however, it should be appreciated that they could alternatively be slightly concave or convex.

Figure 8:
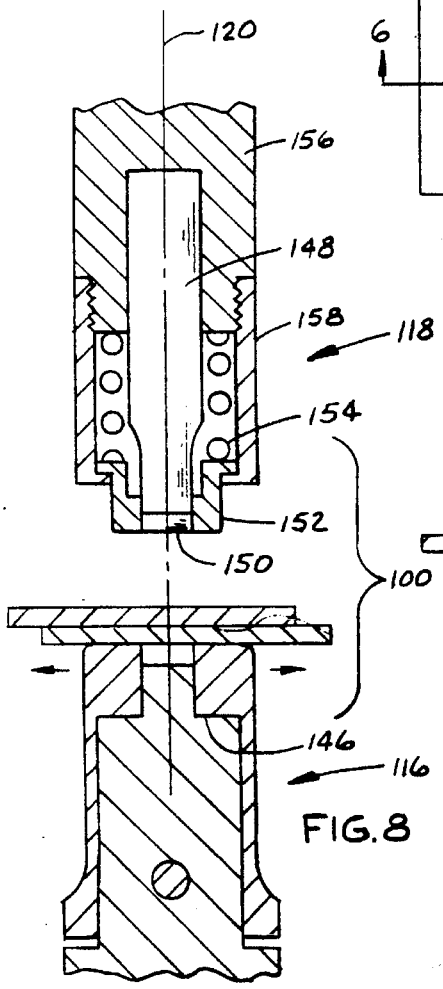
FIG. 8 is a cross-sectional side elevational view of a second embodiment of the invention.

Die button 124 is telescopically received upon mandrel 122 as shown in FIG. 8. Mandrel 122 is generally elongated and coaxially aligned with die axis 120. Mandrel 122 is provided with the first end cantileverly projecting from the die base and a second end adapted to be affixed to the die base which is not shown. An anvil 138 projects axially from the mandrel first end and has an anvil face 140 which is generally flat and lying in a plane perpendicular to the die axis 120. Anvil 138 is generally rectangular in shape and is significantly narrower at a mandrel first end 142 so as to define a pair of shoulders 144 opposite the sides of the anvil as illustrated in FIGS. 8 and 9. The die button head portions 132 are each provided with a land 146 illustrated in FIG. 8 which cooperate with and is substantially parallel to their shoulders 144 on the mandrel first end. During the clinch joint forming operation, the axial loads exerted upon the die button are transmitted through the land 146 on the die button to the shoulders 144 on the mandrel. Leaf portions 130 of the die segments 128 are loaded radially only and are not loaded axially during the forming of the joint.

Punch assembly 118 is made up of a punch 148 having a generally flat end projection 150 provided with a pair of flat parallel sides, generally parallel to the cutting edges 136 of the die button. A stripper 152 surrounds punch end 150 and is telescopically shiftable along the die axis relative thereto. Stripper 152 is spring biased to the axial extended position by stripper spring 154. The stripper is affixed to punch retainer 156 by ring 158 as shown in FIG. 8. In use, stripper 152 will abut first sheet 104 as the clinch joint is being formed. When the punch assembly is raised relative to the die assembly after the joint is formed, the force exerted upon the first sheet 104 by the stripper and stripper spring 152 and 54 will allow the punch end 150 to retract from within the central recess of the formed joint without lifting material.

The width of the punch end 150 is slightly less than the corresponding recess in the anvil in order to provide proper clearance for the shearing operation. This clearance varies with material thickness and material strength and may be calculated in the normal manner. The punch is shown in dotted outline in the FIG. 12 side view and it can be seen that the punch profile generally corresponds to the shape of the lanced joint 102.

While the second embodiment illustrated forms a lance joint using a die with two die segments, it should be appreciated that 3 or more die segments can be utilized to form three or more spaced apart non-intersecting slits in the overlapping sheets which define a central recess and a plurality of webs extending from the central recess to the remainder of the sheets.

Third Apparatus Embodiment

A third embodiment of the clinch joint forming apparatus 180 is illustrated in FIGS. 14–18. Apparatus 180 is used to form a circular leak proof joint similar to that shown in FIGS. 5 and 6, however the periphery of the joint is axially squeezed together to further strengthen the joint. Leak proof joint 182 is formed in first and second sheets 184 and 186.

The first and second sheets are initially overlapped and placed locally adjacent to one another in the region which the clinch joint is formed and aligned within the open apparatus. Clinch forming apparatus 180 is made up of a punch assembly 188 and a die assembly 190 coaxially aligned with one another along a die axis 192. The punch assembly is made up of a punch 194 and a stripper die 196. Punch 194 is provided with a cylindrical punch projection 198 having a generally flat free end 200. Stripper die 196 has a generally flat coining face 202 which lies in a plane generally perpendicular to die axis 192.

Punch forming apparatus 180 is intended to be used in conjunction with a two-stage press of the general type described in U.S. Patent Reissue No. 31535. A two-stage press enables the punch 194 and the stripper die 196, to be axially moved independently of one another.

Die assembly 190 is substantially identical to die assembly 40 of the first embodiment. The only significant difference being the reduced area of die face 204 formed on the upper surface of die button 206. The reduced area face enables the sheets forming the joint to be squeezed in the region immediately surrounding the clinch joint periphery to further strengthen the joint by interlocking the nested cups forming the joint. Coining face 202 is preferably provided with a corresponding face area for engaging the opposite side of the stack of sheets into which the joint is formed.

Figures 14, 15, 16, 17, 18:
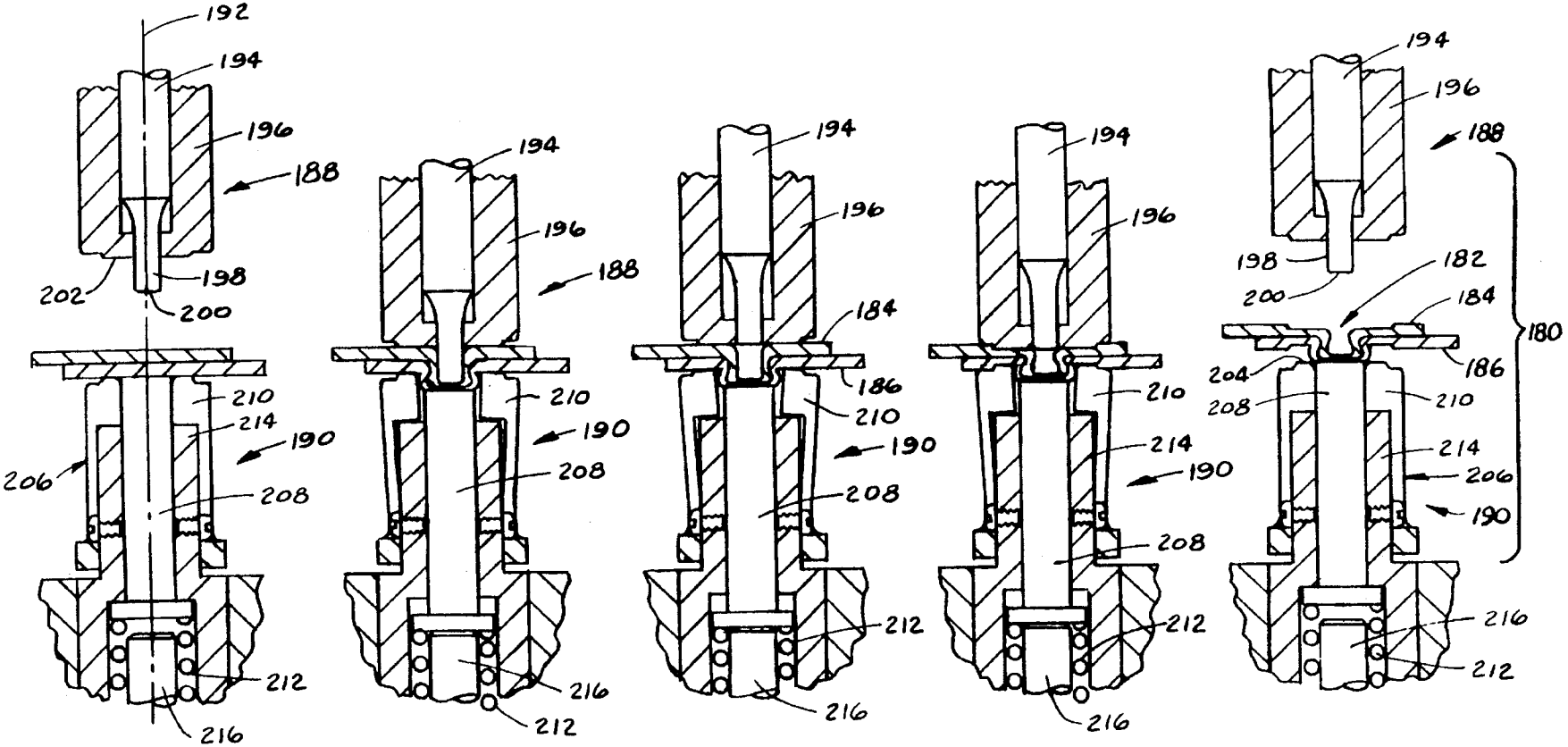
FIGS. 14–18 are cross-sectional side views of a third embodiment of the invention sequentially illustrating the formation of a leak proof joint.

The operation of the device is sequentially shown in FIGS. 14–15. In FIG. 14, the two overlapped sheets 184 and 186 are placed into the open apparatus. In FIG. 15, the punch assembly 188 moves downward causing anvil 208 to retract as the two nested cups are drawn. Once the motion of the anvil is limited by stop 216, the central spot forming the joint is deformed and extruded radially outward causing the die segments 210 to flex open as illustrated. Upon completion of the formation of the cups shown in FIG. 15, the punch 194 retracts leaving the stripper die 196 in contact with the upper surface of first sheet 184 as shown in FIG. 16. Once the punch is completely retracted from within the interior of the joint, the stripper die 196 moves downward as illustrated in FIGS. 17 to squeeze the two sheets together in the region immediately adjacent the periphery of the cups causing material to radially inwardly deform further interlocking the cups. During this coining operation, much more radial deformation can be achieved utilizing apparatus 180 than can be achieved in the first embodiment apparatus 20 since the punch projection is no longer within the interior of the joint.

Once the joint is formed, the punch and die open as illustrated in FIG. 18, allowing the anvil spring 212 to shift the anvil back to the raised position expelling the formed joint from within the die assembly central recess. Throughout this series of steps, the axial downward loads which are exerted upon the die button are carried by mandrel 214 as described with reference to the first and second embodiments.

Fourth Apparatus Embodiment

Figure 19:
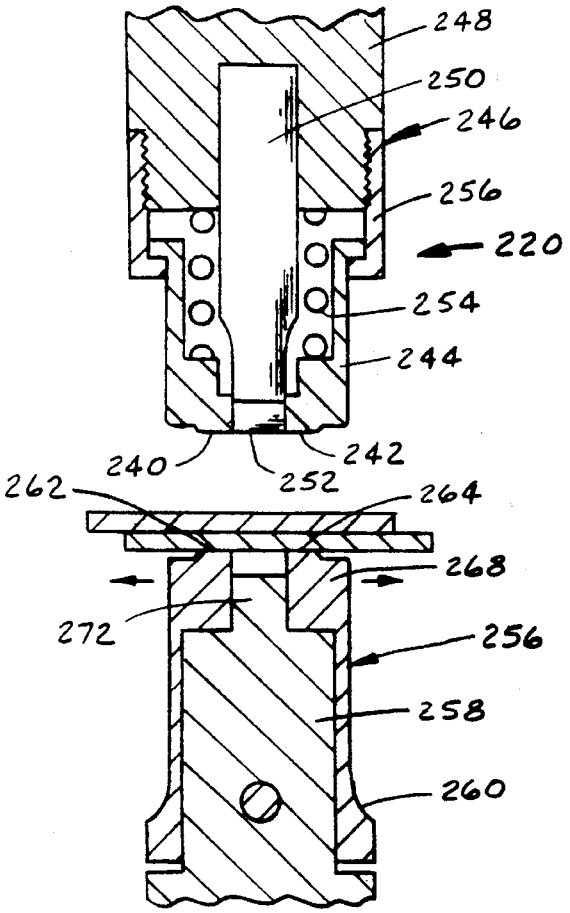
FIG. 19 is a cross-sectional side elevational view of a fourth embodiment of the invention.
Figure 20:
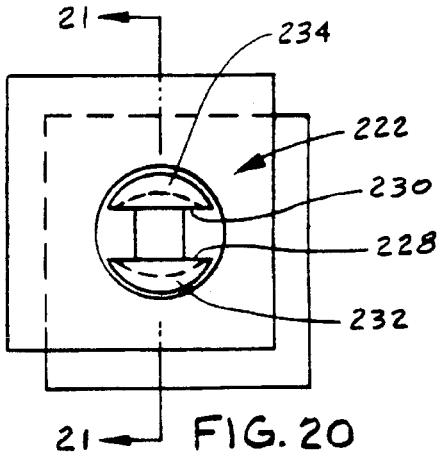
FIG. 20 is a plan view of a clinch joint utilizing the apparatus of FIG. 19.
Figure 21:
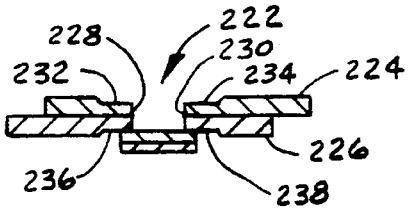
FIG. 21 is a cross-sectional side view of the joint of FIG. 20 taken along line 21-21.

A fourth embodiment of the clinch joint forming apparatus is illustrated in FIG. 19. Apparatus 220 is used to form a lanced joint 222 illustrated in FIGS. 20 and 21. Lance joint 222 is formed in overlapped first and second sheets of deformable material 224 and 226. Lance joint 222 is formed in a similar manner as lance joint 102 described with reference to the second apparatus embodiment previously. The primary difference between the joint 222 formed and the joint 102, is the deformation of the sheets of material immediately adjacent to spaced apart slits 228 and 230. By squeezing of the first and second sheets locally together, adjacent the edges of the slits depressions 232 and 234 are formed in first sheet 224 and depressions 236 and 238 are formed in the second sheet 226 as shown in FIGS. 20 and 21. Depressions 232–238, are in the shape of circular segments having a cord length which corresponds to the length of slits 228 and 230.

Depressions 232 and 234 are formed by lands 240 and 242 on the face of stripper die 244. Punch assembly 246 functions in the same general fashion as punch assembly 118 described with reference to the second apparatus embodiment. The primary difference between punch assembly 246 and punch assembly 118 is the fact that stripper die 244 is used to axially load the material forming the joints sufficiently to cause the formation of depressions 232 and 234.

Punch assembly 246 is made up of a punch holder 248, a punch 250 having a free end 252, a stripper die spring 254 and a retaining ring 256. The stripper die 244 has a limited travel. After the stripper die moves a distance X relative to the punch, the stripper die engages punch retainer 248 and further relative movement is inhibited. As the punch assembly continues to advance, lands 240 and 242 formed on the stripper die, will cause deformation of the overlapping sheets of material in which the joint is formed immediately adjacent the sides of slits 228 and 230.

Figure 24:
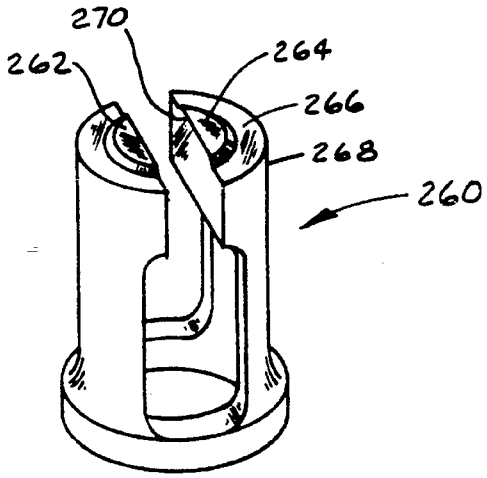
FIG. 24 is a perspective view of the die button shown in FIG. 19.

Die assembly 256 is also generally similar to die assembly 116 described with reference to a second embodiment 100. Die assembly 256 includes a mandrel 258 and a die button 260. The die button is shown in perspective view in FIG. 24. Die button 260 is very similar to die button 124, except for the addition of lands 262 and 264 formed on the face surfaces 266 of the die button head portion 268. Lands 262 and 264 are circular segments having a cord which defines a cutting edge 270.

In operation, the joint forming apparatus 220 functions very similar to apparatus 100 of the second embodiment. It should be noted, however, that when the joint is being squeezed, the central spot will be squeezed between anvil 272 and punch free end 252 while the material adjacent the edges of the slits 228 and 230 will be compressed between the lands on the die button 260 and stripper die 244.

Figure 23:
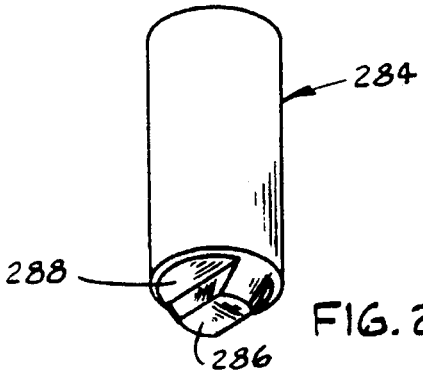
FIG. 23 is a perspective view of the punch shown in FIG. 22.
Figure 22:
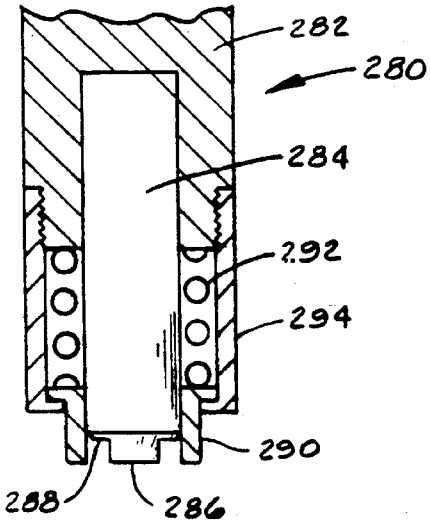
FIG. 22 is an alternative punch assembly suitable for use with the fourth embodiment of the invention.

Utilizing punch assembly 246, it is important to carefully control the relationship between the punch 250, stripper die 244 and punch holder 248. The punch position within punch holder must be carefully selected to that the proper amount of squeezing takes place both at the joint central spot and at the edges adjacent the slits. In an effort to simplify the punch design and to precisely control the distance between the punch face and the adjacent land, an alternative punch assembly design as illustrated in FIGS. 22 and 23.

Punch assembly 280 is made up of a punch holder 282, a punch 284 having a punch projection 286 formed on the end thereof and a pair of lands 288 spaced on opposite sides of the punch projected 286. A simple circular stripper 290 surrounds punch 284 and is downwardly axially biased by spring 292 and held in place by retainer ring 294. The distance between punch free end 286 and the land 288 is fixed at all times and is not subject to adjustment. This also can be a disadvantage since in some situations adjustment is required due to a variation in metal thickness.

Lance Type Clinch Joint

Lance joint 222 made using the apparatus described in the previous section is itself novel over joints of the prior art design. The joint is formed of a plurality of nonintersecting slits cut through the overlapping sheets of deformable material defining a central spot connected to the remainder of the sheets by a plurality of webs. The joint has both the central spot as well as local regions of the sheets adjacent the nonintersecting slits are squeezed together causing a central spot to plastically deform radially outward and the local regions of the sheets to plastically deform radially inwardly thereby securely fastening the sheets together.

The local regions of the sheets adjacent the nonintersecting slits are plastically deformed inwardly a distance which is substantially equal to the die clearance between the punch and the die at the time of formation of the slits. The plastic deformation of a central spot is greater than the die clearance between the punch and the die at the time of formation of the slit as a result of the outward radial expansion of the die segments during joint formation.

In the preferred embodiment of the joint illustrated in FIG. 20, two parallel slits, 228 and 230 are formed which define cords of a circle. The local regions adjacent the nonintersecting slits which are squeezed together form recesses 232–238. These local regions are bounded generally by the circle in one of the slits to define a chordal shape indentation. By utilizing a chordal shape recess, stress in the region of the termination of the slit is minimized while sufficient plastic deformation occurs to achieve a strong joint.

While the best modes for carrying out the invention have been described in detail, those familiar with the art to which the invention relates will recognize various alternative designs and embodiments for practicing the invention as defined by the following claims.

I claim:

1. A method of forming a clinch joint fastening a plurality of sheets of deformable material together, comprising:

overlapping the sheets to be fastened together in a generally parallel relationship to form an overlap region having a first side and a second side;

positioning the first side of the overlap region, adjacent a die assembly which includes an elongated mandrel having first and second ends aligned along a die axis, an anvil projecting axially from the mandrel first end providing an anvil face and defining a shoulder on the mandrel extending about the anvil generally perpendicular to the die axis, and a die button surrounding the mandrel having a die button base ring and a plurality of die segments each having a leaf portion cantileveredly extended axially from the base ring toward the anvil and having an enlarged head portion at the free end of the leaf portion extending radially inward toward the anvil to collectively provide a die face surrounding the anvil and a central die recess, each of said head portions having a land generally parallel to and in cooperative support relationship with the mandrel shoulder to transmit axial loads exerted thereon into the mandrel;

positioning a punch adjacent the second side of the overlap region aligned coaxially with the first die recess;

drawing the sheets into the die recess by moving the punch relative to the die assembly deforming the material out of the plane of the overlap region into the die recess, while transmitting axial loads exerted on the die face during drawing directly from the head portion lands into the mandrel shoulder without axially loading die segment leaf portions;

squeezing the material between the punch and anvil together to radially extrude the material therebetween outwardly biasing the die segment heads as the die segment leaf portions elastically flex retracting the punch after the material between the punch and anvil has been squeezed together to allow the material immediately surrounding the joint periphery to radially inwardly extrude;

providing a stripper-die adjacent the second side of the overlap region, said stripper-die having a raised face surrounding the punch aligned with the die button face; and opening the punch and die assembly allowing the finished joint to be removed.

2. A method of forming a clinch joint-fastening a plurality of sheets of deformable material together, comprising:

overlapping the sheets to be fastened together in a generally parallel relationship to form an overlap region having a first side and a second side;

positioning the first side of the overlap region adjacent a die assembly which includes an elongated mandrel having first and second ends aligned along a die axis, an anvil projecting axially from the mandrel first end providing an anvil face and defining a shoulder extending about the anvil generally perpendicular to the die axis, and a die button surrounding the mandrel having a die button base ring and a plurality of die segments each having a leaf portion cantileveredly extended axially from the base ring toward the anvil and having an enlarged head portion at the free end of the leaf portion extending radially inward toward the anvil to collectively provide a die face surrounding the anvil and a central die recess, each of said head portions having a land generally parallel to and in cooperative support relationship with the mandrel shoulder to transmit axial loads exerted thereon into the mandrel;

positioning a punch adjacent the second side of the overlap region aligned coaxially with the first die recess;

drawing the sheets into the die recess by moving the punch relative to the die assembly deforming the material out of the plane of the overlap region into the die recess forming a plurality of spaced apart non intersecting slits in the overlapping sheets, while transmitting axial loads exerted on the die face during drawing directly from the head portion lands into the mandrel shoulder without axially loading the die segment leaf portions;

squeezing the material between the punch and anvil together to radially extrude the material therebetween outwardly biasing the die segment heads as the die segment leaf portions elastically flex; and opening the punch and die assembly allowing the finished joint to be removed.

3. The method of claim 1 wherein the step of drawing the sheets further comprises forming a pair of nested cups in overlapped sheets to create a leak proof joint.

* * * * *